United States Patent [19]

Hujer et al.

[11] 3,948,125

[45] Apr. 6, 1976

[54] APPARATUS FOR TREATING WEBS OF PHOTOGRAPHIC MATERIAL OR THE LIKE

[75] Inventors: Friedrich Hujer, Grunwald; Ferdinand Schaner, Munich, both of Germany

[73] Assignee: AGFA-Gevaert, A.G., Leverkusen, Germany

[22] Filed: Sept. 20, 1973

[21] Appl. No.: 399,058

[30] Foreign Application Priority Data

Sept. 22, 1972 Germany ..... 2246467
Jan. 16, 1973 Germany ..... 2301885

[52] U.S. Cl. ..... 83/62; 83/208; 83/210; 83/221; 83/364

[51] Int. Cl.[2] ..... B26D 5/24

[58] Field of Search ..... 83/210, 208, 62, 221, 364, 83/369, 371

[56] References Cited

UNITED STATES PATENTS

| | | | |
|---|---|---|---|
| 3,600,997 | 8/1971 | Schmidt | 83/210 |
| 3,699,832 | 10/1972 | Smith et al. | 83/210 |
| 3,763,728 | 10/1973 | Blackman | 83/210 |
| 3,793,915 | 2/1974 | Hujer | 83/210 |
| 3,796,117 | 3/1974 | Toshiaki et al. | 83/210 |

*Primary Examiner*—Donald R. Schran
*Attorney, Agent, or Firm*—Michael J. Striker

[57] ABSTRACT

Apparatus for subdividing webs of photographic paper into discrete prints has a detector which scans marks applied to the web for the purpose of arresting the drive for the web at the exact moment when the central portion of a frame line between two successive images on the web is in register with the knives. The signals which are furnished by the detector can be used to arrest the drive only within a short interval of time which begins shortly or immediately before a mark reaches the detector. This prevents the detector from arresting the drive in response to detection of a flaw or a particle of foreign matter whose effect upon the detector is similar to that of a mark.

18 Claims, 5 Drawing Figures

APPARATUS FOR TREATING WEBS OF PHOTOGRAPHIC MATERIAL OR THE LIKE

BACKGROUND OF THE INVENTION

The present invention relates to apparatus for treating webs of photographic material or the like, particularly for severing a web of photographic paper in a processing laboratory at regular or irregular intervals to thereby subdivide the web into a series of discrete prints which are collected together with the corresponding film or films and shipped to or picked up by customers.

It is already known to transport a web which carries a series of images of film frames in an apparatus wherein the actuation of a suitable severing or cutting device is initiated in response to detection of indicia in the form of graphite marks, notches, perforations or the like applied to the web at such intervals that each indicium is located at a predetermined distance from a line along which the web is to be severed to separate therefrom the foremost print of a customer order.

A drawback of presently known apparatus is that the detector means which is used to scan the web for the presence of indicia and to produce signals serving to initiate successive severing operations is likely to produce such signals in response to detection of unintentionally applied or accidentally formed indicia. For example, a detector means which employs a photoelectric cell is likely to produce a signal in response to detection of a crack, a foreign particle, a tear in a marginal portion of the web and/or other imperfections whereby the web is likely to be severed across the image of a film frame or to be severed between a frame line and the adjacent image.

Another drawback of presently known apparatus is that their detector means is not capable of invariably detecting the indicia, particularly graphite marks which are normally applied to the rear side of a web of photographic paper, if the quality (particularly the sharpness) of indicia is affected by liquid when the web must be transported through one or more liquid baths prior to reaching the severing station. The detector means often responds to detection of localized contamination of a travelling web which is likely to occur when the web is caused to travel through a developing machine with one or more liquid baths and one or more drying stations. The situation is analogous when the indicia are in the form of marks which are exposed on the emulsion-coated front side of the web; such indicia are also likely to be confused by detector means with spots or particles of foreign matter on the travelling web.

SUMMARY OF THE INVENTION

An object of the invention is to provide a novel and improved apparatus for treating webs of photographic material or the like wherein the fact that a detector is likely to produce signals in response to detection of unintentionally provided or accidentally applied indicia cannot affect the operation of those parts and/or devices which receive signals from the detector means and are supposed to perform one or more functions only when the signals are produced in response to detection of intentionally applied indicia.

Another object of the invention is to provide an apparatus for intermittently severing a web of photographic material wherein the means for severing and the means for arresting the web immediately prior to severing are deactivated during the major part of each stage of intermittent movement of the web so that the detection of unintentionally applied indicia cannot, and normally does not, initiate an actuation of the severing and/or arresting means.

A further object of the invention is to provide an apparatus of the just outlined character with means which insures that the generation of signals by a photoelectric cell or other suitable detector means affects the treatment of a web only when such signals are generated in response to detection of indicia whose positions with respect to successive sections of the web are such as to insure the subdivision of a web into discrete sections with a high degree of accuracy and without risking the severing of webs across the images of film frames and/or not exactly midway across successive frame lines between neighboring images.

An additional object of the invention is to provide an apparatus which can be used in processing laboratories for exposed customer films to subdivide elongated webs of photographic paper into discrete prints which are ready to be shipped to or picked up by customers.

An ancillary object of the invention is to provide novel and improved operative connections between the detector means for indicia on a web of photographic paper and the means for intermittently advancing and intermittently severing the web.

The invention is embodied in an apparatus for treating a web which is provided with substantially uniformly spaced indicia in the form of graphite marks, notches, perforations or the like which can be applied to a marginal portion at the front or rear side of the web, particularly for subdividing a web of photographic material into sections or prints each of which carries the image of a film frame. The apparatus comprises advancing means (e.g., two rollers and a motor which drives one of the rollers) which is operable to advance a web lengthwise along a predetermined path, detector means (e.g., a photoelectric cell) adjacent to a portion of the path and serving to scan the web for the presence of indicia and to produce signals in response to detection of indicia on the moving web, arresting means (e.g., a device which opens the circuit of the motor for one of the advancing rollers and which can simultaneously brake the web and/or the motor) which is activatable to terminate the operation of advancing means in response to signals from the detector means (thus, in order to be capable of terminating the operation of advancing means for the web in response to a signal from the detector means, the arresting means must be activated or rendered operative in order to be capable of performing its arresting function upon receipt of a signal), and means for controlling the arresting means in such a way that the arresting means can be activated immediately or shortly prior to anticipated reception of a signal from the detector means. This insures that the arresting means cannot interrupt the transport of a web when the detector means produces a signal at an inopportune time, for example, in response to detection of a smudge, crack, foreign particle or any other imperfection or flaw whose effect upon the detector means is the same as or similar to that of an indicium.

In accordance with a feature of the invention, the means for controlling the arresting means comprises means for deactivating the arresting means not later than on start of operation of the advancing means, and means for activating the arresting means in response to completed transport of the web through a predetermined distance which is preferably only slightly less than the distance between a pair of neighboring indicia on the web. This insures that the arresting means can terminate the operation of advancing means only after the web is transported through a predetermined distance and after the detector means produces a signal in response to detection of an oncoming indicium.

The means for deactivating the arresting means may comprise a logic circuit which can transmit signals to the arresting means only when it receives a signal from a metering device or a photoelectric cell which furnishes such signal only when the web has been moved lengthwise through the aforementioned predetermined distance. Such metering device or cell then constitutes the means for activating the arresting means.

The means for severing the web can be actuated in response to stoppage of the web or in response to deactivation of arresting means and subsequent to generation of a signal in response to detection of an oncoming indicium.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
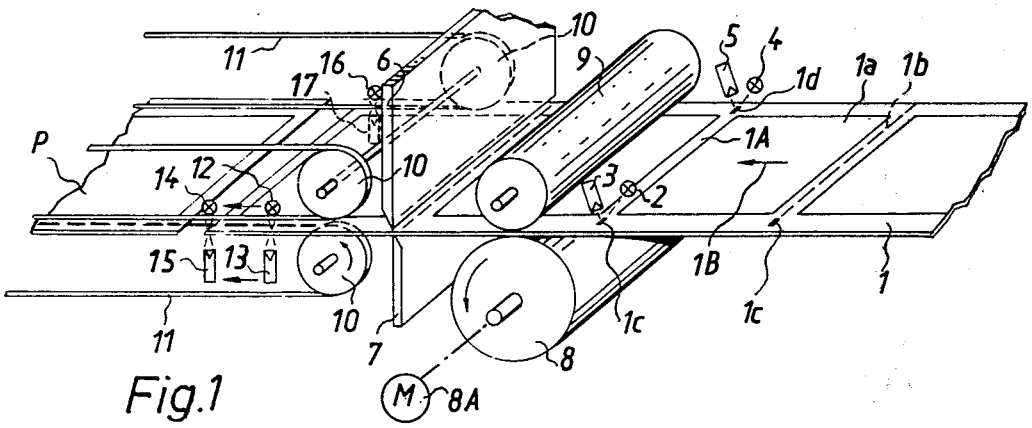
FIG. 1 is a fragmentary perspective view of an apparatus which embodies one form of the invention.

Referring first to FIG. 1, there is shown a web 1 of photographic paper one side of which is coated with a photosensitive emulsion and is provided with a series of substantially or exactly equidistant images 1*a* separated from each other by frame lines 1A. The images 1*a* are reproductions of successive frames of a photographic film and are produced at a copying station, not shown. The emulsion of the web 1 is assumed to have been developed so that the web 1 is ready to be subdivided into a series of shorter sections or prints P each of which carries one of the images 1*a*. The broken lines 1*b* indicate the central portions of the respective frame lines 1A where the web 1 is to be severed by a cutter including a fixed counterknife 7 and a vertically movable knife 6.

Each line 1*b* is (but need not be) in register with a mark or indicium 1*c* which is to be scanned for the purpose of generating a signal which serves to initiate a downward movement of the upper knife 6 with the result that the web 1 is severed across the median portion of the respective frame line 1A.

The marks 1*c* can be exposed onto the emulsion-coated side of the web 1, or they may be applied to the web *y* a conventional graphite wheel (not shown) or by other suitable marking means.

The means for scanning the web 1 for successive marks 1*c* comprises a photoelectric detector including a light source 2 and a photosensitive receiver 3. The light issuing from the source 2 is reflected into the receiver 3 by an oncoming mark 1*c* whereby the receiver 3 produces an electric signal which is used to actuate the mobile knife 6 with a requisite delay, i.e., with a delay which is necessary to advance the corresponding line 1*b* into the space between the edges of the knives 6 and 7.

The web 1 is further provided with a second series of indicia or marks 1*d* each of which indicates the end of a customer order. It is well known to splice together two or more photographic roll films prior to transport of such films through a developing machine and thereupon through a copying machine where the frames of successive films are imaged onto a web 1. The web carries a large number of images 1*a* which may but need not belong to a single customer. If the images belong to several customers, a mark 1*d* indicates the last image of the preceding customer order or the foremost image of the next-following customer order. The marks 1*d* are applied to the right-hand marginal portion and the marks 1*c* are applied to the left-hand marginal portion of the web 1, as considered in the direction (arrow 1B) of lengthwise movement of the web toward the severing station.

The means for scanning the web 1 for the presence of marks 1*d* comprises a second photoelectric detector including a light source 4 and a photosensitive receiver 5. Signals produced by the receiver 5 are used to segregate the preceding group of prints P from the next-following group of prints.

The advancing means for intermittently transporting the web 1 lengthwise (arrow B) comprises a first advancing roller 8 which is rotated by a motor 8A and a second advancing roller 9 which is an idler roller. The rollers 8, 9 are installed upstream of the severing station and the motor 8A for the roller 8 is preferably designed to act as a brake as soon as the forward speed of the web 1 begins to decrease. This renders it possible to reduce the duration of intervals which are necessary to advance the web 1 by the length of an image as well as to place successive lines 1*b* into accurate register with the cutting edges of the knives 6 and 7. Reference may also be had to German Offenlegungsschrift No. 2,048,413.3 which describes an auxiliary brake adapted to be used in the apparatus of FIG. 1 to rapidly decelerate the web 1 as soon as a line 1*b* moves close to the severing station.

The apparatus of FIG. 1 further comprises a second transporting device for discrete prints P of the web 1. This transporting device comprises two pairs of endless rubber belts 11 which are trained over driven rollers 10 and which can engage and entrain the leading edge of the web 1 as soon as it advances beyond the common plane of the edges of the knives 6 and 7. Such leading edge of the web 1 enters between the lower stretches of the upper belts 11 and the upper stretches of the lower belts 11. The belts 11 advance successive prints P to a collecting or intercepting receptacle, not shown. The speed of movement of the belts 11 equals or closely approximates the peripheral speed of the driven roller 6 to thus insure that the leading edge of the web 1 and also the prints P are advanced at the exact speed of the web 1 upstream of the severing station. It will be noted that the belts 11 transport the prints P as well as the leader of the web 1 while such leader advances through the gap between the knives 6, 7 when the roller 6 is in motion. The motor 8A for the roller 8 preferably drives the rollers 10 for the belts 11.

Still further, the apparatus comprises a third photoelectric detector including a receiver 13 and a light source 12. The detector including the parts 12, 13 is located downstream of the severing station (as considered in the direction of arrow 1B) and is spaced apart from the plane of the cutting edges of knives 6, 7 by a distance corresponding to or slightly less than the distance between two neighboring marks 1*c* on the web 1. The receiver 13 produces a signal when the light beam issuing from the source 12 is interrupted by the leading edge of the web 1.

The detector including the parts 12, 13 is followed by a detector including a light source 14 and a receiver 15. The distance between the detectors 12, 13 and 14, 15 is less than that between two neighboring marks 1*c*.

Still another detector, including a light source 16 and a receiver 17, is located downstream of the severing station in line with the detector 4, 5. The distance between the detector 16, 17 and the plane of the cutting edges of the knives 6, 7 corresponds to the distance between a mark 1*d* and the line 1*b* behind the last image of a customer order.

Figure 2:
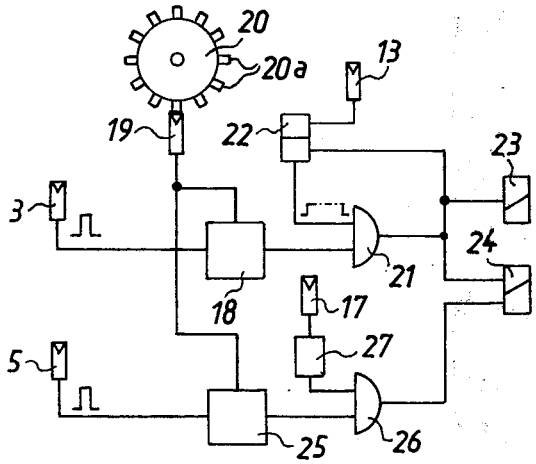
FIG. 2 is a diagram of the electric circuit for the apparatus of FIG. 1.

The electric circuit of the apparatus of FIG. 1 is shown in FIG. 2. The receiver 3 transmits signals to the first input of a time-delay device 18, e.g., a counter, the second input of which receives pulses from the receiver 19 of a further photoelectric detector cooperating with a timer wheel 20 rotating at a speed which corresponds to the speed of lengthwise movement of the web 1. The counter 18 is preferably adjustable so that it can be used in an apparatus for severing webs whose images are longer or shorter than the illustrated images 1*a*. The opaque vanes 20*a* of the wheel 20 interrupt the light beam between the receiver 19 and the associated light source (not shown) at regular intervals whenever the web 1 is in motion so that the second input of the counter 18 receives a number of pulses which are stored therein until the counter 18 receives a predetermined number of pulses. The output of this counter then transmits a signal to the first input of an AND-gate 21 the second input of which is connected with the output of a signal storing device here shown as a flip-flop 22. The setting input of the flip-flop 22 receives signals from the receiver 13. The output of the AND-gate 21 transmits a signal when its second input receives a signal from the output of the flip-flop 22, namely, when the receiver 13 produces a signal in response to detection of the leading edge of the web 1 behind the severing station. The erasing input of the flip-flop 22 is connected to an electromagnet 23. The electromagnet 23 (or an electric motor, not shown) serves to move the knife 6 downwardly, i.e., to initiate a severing action. The output of the AND-gate 21 is further connected with an electromagnet 24 which constitutes an arresting means in that it can convert the motor 8A for the intermittently driven advancing roller 8 into a braking device in a manner as explained above.

The signal from the receiver 5 is transmitted to the first input of a second time-delay device 25 which is similar to or identical with the counter 18 and the second input of which is connected with the receiver 19. The output of the counter 25 is connected to the first input of an AND-gate 26 the second input of which is connected to the receiver 17 through the medium of an RC-link 27. The output of the AND-gate 26 is connected to the arresting electromagnet 24.

The operation is as follows:

When the motor 8A is started, the rollers 8, 9 cooperate to move the web 1 lengthwise (arrow 1B). Thus, a mark 1*c* advances beyond the detector 2, 3 and the first input of the counter 18 does not receive a signal from the receiver 3. The output of the flip-flop 22 does not transmit a signal to the corresponding input of the AND-gate 21 because the erasing input of the flip-flop 22 has received a signal from the electromagnet 23 upon completion of the preceding severing operation.

As the web 1 continues to advance, the oncoming mark 1*c* causes the detector 2, 3 to transmit a signal to the counter 18 which is activated and begins to count the pulses furnished by the receiver 19. The number of pulses which the counter 18 receives prior to transmitting a signal to the first input of the AND-gate 21 is selected in such a way that the gate 21 receives a signal shortly before the oncoming line 1*b* reaches the severing station. The second input of the gate 21 receives a signal from the receiver 13 before the first input receives a signal from the couner 18 (see the position of the detector 12, 13 in FIG. 1) so that the electromagnets 23, 24 are energized as soon as the output of the counter 18 transmits a signal to the gate 21. The electromagnet 24 causes the motor 8A to brake the roller 8 and web 1 and the electromagnet 23 transmits a signal to the erasing input of the flip-flop 22. The web 1 comes to a halt at the exact moment when the oncoming line 1*b* registers with the cutting edges of the knives 6, 7. The magnet 23 also causes the knife 6 to descend and to sever the web 1 across the center of the adjacent frame line 1A. The separated section of print P of the web 1 is engaged by the belts 11.

The motor 8A is started again, preferably automatically and with a delay which suffices to complete a severing operation, and the just described sequence of steps is repeated again and again.

When the detector including the receiver 5 detects an oncoming mark 1*d*, it starts the counter 25 which begins to count the pulses furnished by the receiver 19. The counter 25 transmits a signal to the gate 26 upon receipt of a predetermined number of pulses, and the gate 26 energizes the electromagnet 24 which initiates a stoppage of the web 1 without any severing of the web by the knives 6, 7. The receiver 17 transmits to the gate 26 a signal shortly before the latter receives a signal from the counter 25. The stoppage of motor 8A in response to energization of the electromagnet 24 by the gate 26 is long enough to insure that the previously accumulated prints P of the web 1 can be removed from the collecting receptacle which thereupon begins to collect the next series of prints P belonging to the next-following customer order.

An important advantage of the apparatus of FIG. 1 is that the knives 6, 7 are highly unlikely to sever the web 1 in response to detection (by 2, 3) of a mark which might resemble a mark 1*c* but is not provided on the web for the purpose of initiating a severing action. Thus, even if the receiver 3 reacts in response to detection of an imperfection of the web 1 which might have the same effect as a mark 1*c*, the electromagenta 23 and 24 are not energized because the AND-gate 21 receives a signal from the flip-flop 22 only shortly before the web 1 is advanced through a distance corresponding to that between two neighboring lines 1B. The situation is analogous in connection with the receiver 5, i.e., when the receiver 5 furnishes a signal in response to detection of a mark other than one of the marks 1*d*.

The AND-gate 21 consitutes a means for deactivating or deenergizing the electromagnet 24 not later than when the motor 8A causes the advancing rollers 8, 9 to begin with the transport of the web 1. The detector 12, 13 and the flip-flop 22 constitutes a means for activating or energizing the arresting electromagent 24 in response to transport of the web 1 through a predetermined distance which is less than the distance between two neighboring marks 1*c* on the web 1 so that the electromagent 24 can terminate the operation of the advancing means 8, 8A, 9 only after the web is advanced through the aforementioned predetermined distance. In other words, the detection of a mark 1*c* by the detector 2, 3 can result in severing of the web 1 only if such detection takes place after the detector 12, 13 has transmitted a signal to the setting input of the flip-flop 22.

If a defect of the web 1 (in line with the marks 1*c*) causes the detector 2, 3 to transmit a signal to the corresponding input of the counter 18, the signal from the counter 18 can reach the gate 21 but does not initiate an energization of the electromagnets 23, 24 for the aforementioned reason, i.e., because the gate 21 does not receive a signal from the receiver 13 via flip-flop 22. Moreover, the oncoming properly applied mark 1*c* causes the detector 2, 3 to reset the counter 18 to zero so that the signal at the output of the counter 18 disappears and the counter begins to count the pulses furnished by the receiver 19 upon receipt of a signal from the receiver 3 (i.e., on detection of a mark 1*c*).

If desired, the erasing input of the flip-flop 22 can receive signals from the detector 14, 15 which is installed close to and downstream of the detector 12, 13. Such modification is desirable and practical if the rollers 10 are driven continuously, i.e., also when the rollers 8, 9 are at a standstill. If the transporting means 10, 11 is omitted, the detector 14, 15 can be installed immediately downstream of the severing station to transmit signals to the erasing input of the flip-flop 22 as soon as it detects the leading edge of the web 1 downstream of the knives 6, 7. It will be noted that the detector 14, 15 can be used in addition to or as a substitute for the connection between the electromagnet 23 and the erasing input of the flip-flop 22.

Figure 3:
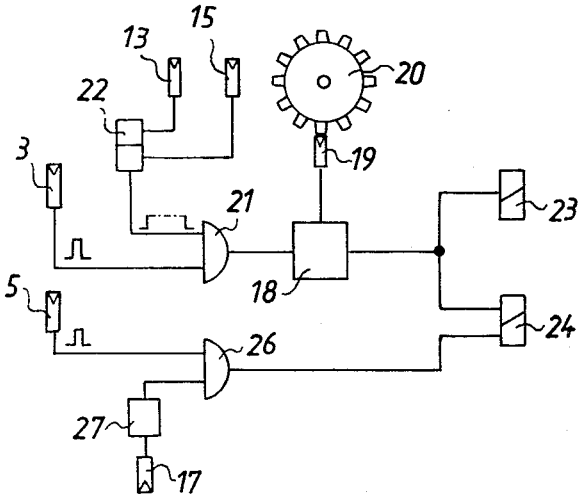
FIG. 3 is a diagram of a modified circuit.

FIG. 3 illustrates the electric circuit of a modified severing apparatus. The detector 12, 13 is assumed to be separated from the detector 2, 3 by a distance which is slightly less than that between two neighboring marks 1*c*. The deactivating means for preventing a premature transmission of signals to the electromagnets 23, 24 is the counter 18 which is installed behind the AND-gate 21, i.e., one input of the counter 18 receives signals from the output of the gate 21. The gate 21 cooperates with the flip-flop 22 to prevent premature starting of the counter 18. The means for transmitting signals to the erasing input of the flip-flop 22 is the receiver 15 of the detector 14, 15.

The receiver 17 of the detector 16, 17 is connected to the first input of the AND-gate 26 by means of the R-C link 27. The second input of the AND-gate 26 is connected to the receiver 5. The link 27 constitutes a signal holding device which insures that the arresting electromagnet 24 remains energized for a predetermined interval of time. This renders it possible to omit the counter 25 of FIG. 2.

The minimum length of intervals during which the signals from the receiver 3 are effective to insure that the roller 8 is braked depends on the extent to which the positions of lines 1*b* on the web 1 deviate or are likely to deviate from optimum positions of exact register with the plane of the edges of the knives 6, 7. Thus, a mark 1*c* should not reach the detector 2, 3 at a time when the resulting signal could not be transmitted (with requisite delay) to the electromagnets 23 and 24. It is even more important to prevent the knife 6 from descending before its cutting edge is in register with a frame line 1A because this would result in cutting across one of the images 1*a* on the web 1. As a rule, the marks 1*c* are applied with a high degree of precision while the web 1 travels through the copying station; therefore, the receiver 13 can be located at such a distance from the severing station that the second input of the AND-gate 21 receives a signal only immediately before a mark 1*c* reaches the detector 2, 3. In this way, the receiver 3 cannot initiate an energization of electromagnets 23, 24 in response to detection of an unwanted mark whose effect is the same as that of a mark 1*c*, except in the extremely unlikely event that an unwanted mark is closely adjacent to and immediately precedes a mark 1*c*, i.e., when an unwanted mark causes the receiver 3 to transmit to the counter 18 or AND-gate 21 a signal which precedes a desirable signal from the receiver 3 (in response to detection of a mark 1*c*) by an interval which is so short that it merely results in severing of a frame line 1A slightly ahead of the respective center line 1*b*. This would merely produce a slight defect in the appearance of two successive prints P but would not render such prints unacceptable for shipment to a customer.

If the distance between the receiver 3 and the severing station equals the distance between the mark 1*d* and a mark 1*c*, the wheel 20, the detector including the receiver 19, the counter 18 and the counter 25 can be dispensed with without affecting the efficiency of the apparatus. The AND-gate 21 of FIG. 2 or 3 then receives signals directly from the receivers 3, 13, and the AND-gate 26 receives signals directly from the receivers 5, 17.

Figure 4:
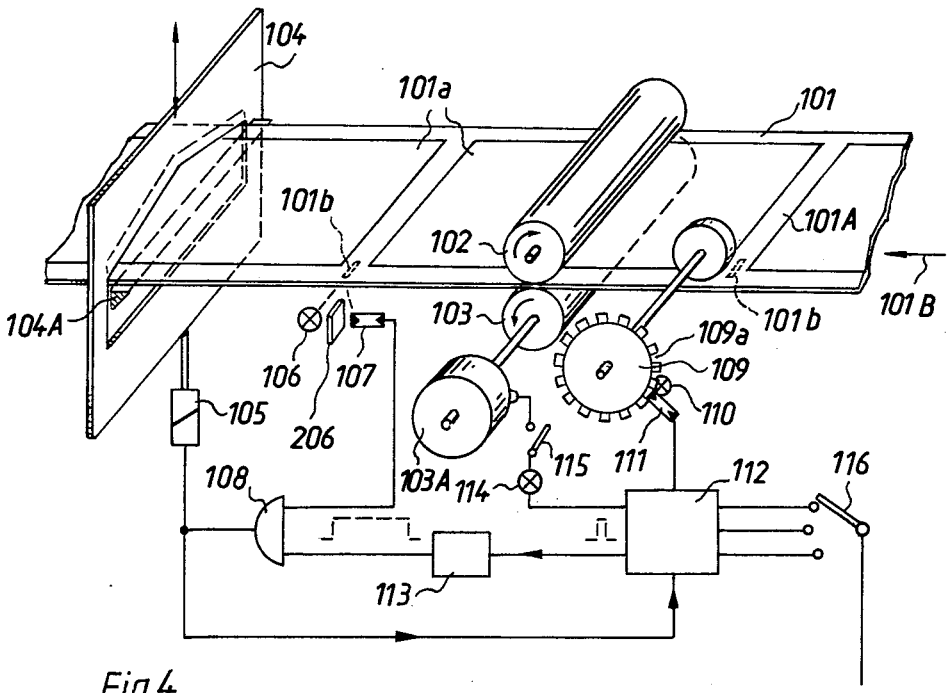
FIG. 4 is a fragmentary partly diagrammatic and partly perspective view of a further apparatus.

FIG. 4 illustrates a further apparatus wherein a web 101 is provided with a series of images 101*a*. A mark 101*b* is applied to the web 101 for each of the images 101*a*; the marks 101b have been applied by a graphite wheel and each thereof is provided on the rear (uncoated) side of the web 101. As a rule, graphite marks are applied while the web 101 is at a standstill between successive stepwise movements through a copying station where the emulsion-coated side is provided with the images 101*a*. It is clear that graphite marks can be replaced by indicia which are exposed on the front side and along one marginal portion of the web 101. The rollers 102, 103 serve to advance the web 101 from the developing machine (not shown) toward the severing station (see the movable knife 104 and the fixed knife 104A). The roller 103 is driven by a motor 103A. The means for moving the knife 104 downwardly after the web 101 comes to a halt comprises an electromagnet 105 corresponding to the electromagnet 23 of FIG. 2 or 3. The electromagnet 105 can further serve to disengage the web 101 from the driven roller 103 and to initiate a braking action to thus allow for a rapid deceleration of the web to zero speed. Reference may be had to German Pat. No. 2,048,413 granted on application No. P 20 48413.3.

The means for scanning the web 101 for the presence of marks 101*b* comprises a detector including a light source 106 and a receiver 107. A mask 206 prevents direct illumination of the receiver 107 by light which issues from the source 106; the receiver 107 receives only such light which issues from the source 106 and is reflected by a mark 101*b*. The construction of the detector 106, 107 may be similar to that of detector means disclosed in German Utility Model No. 7,033,182. The receiver 107 is connected to the first input of an AND-gate 108. The output of the gate 108 is connected with the electromagnet 105 and its second input is connected to the output of a signal holding device 113.

The web 101 drives a wheel 109 having an annulus of opaque vanes separated by slots 109*a*. The vanes of the wheel 109 travel across the path of a light beam issuing from a light source 110 and impinging on the surface of a photosensitive receiver 111 connected to one input of a counter 112. Another input of the counter 112 is connected to the output of the AND-gate 108, and the output of the counter 112 is connected to the input of the signal holding device 113. A multi-position selector switch 116 is provided to adjust the counter 112 so that the latter transmits to the device 113 a signal in response to reception of a selected number of pulses from the receiver 111. In the illustrated embodiment, the switch 116 is set to adjust the counter 112 for reception of three different numbers of pulses prior to transmission of a signal to the device 113. The transmission of a signal from the device 113 to the AND-gate 108 results in transmission of a short-lasting signal to the electromagnet 105 and to the resetting input of the counter 112. The detector 106, 107 is effective only during the short interval when the second input of the AND-gate 108 receives a signal from the device 113.

A second output of the counter 112 is connected with a signal lamp 114 and a switch 115 which serves to arrest the motor 103A under certain circumstances.

The operation of the apparatus of FIG. 4 is as follows:

Prior to introduction of a web 101 into the nip of the advancing rollers 102, 103, the position of the movable contact of the switch 116 is selected in such a way that the number of pulses furnished by the receiver 111 for the purpose of producing a signal at the first output of the counter 112 is a function of the length of images 101*a* on the web 101. The number of pulses is less than the maximum number of pulses transmitted by the receiver 111 in response to transport of the web 101 by a distance equal to that between two successive marks 101*b*.

The electromagnet 105 is energized for the first time when the movable knife 104 registers with the frame line 101A at the front end of the foremost image 101*a*. Thus, the knife 104 cooperates with the knife 104A to trim the leader of the web 101. As the electromagnet 105 becomes energized, the counter 112 is automatically reset to zero and the motor 103A is started in a fully automatic way to begin with lengthwise transport of the web 101 (arrow 101B).

During the initial stage of transport of the web 101 through a distance corresponding to that between two successive marks 101*b*, the output of the device 113 does not transmit a signal to the lower input of the AND-gate 108. Therefore, a signal from the receiver 107 cannot trigger a severing action or, otherwise stated, detection by the scanning means 106, 107 of a mark other than a mark 101*b* but having the same effect on the light beam issuing from the source 106 will not result in an energization of the electromagent 105 as long as the output of the device 113 does not transmit a signal to the corresponding input of the AND-gate 108.

As the web 101 advances in the direction indicated by arrow 101B, the web rotates the wheel 109 and the counter 112 records the pulses transmitted by the receiver 111. When the sum of such pulses reaches the number selected by the switch 116, i.e., when the oncoming mark 101b is close to the detector 106, 107, the first output of the counter 112 transmits a signal to the signal holding device 113 which immediately transmits to the lower input of the AND-gate 108 a signal of predetermined duration. The duration of such signal is preferably such that it is twice the length of the interval elapsing between the transmission of a signal from the device 113 and the arrival of the mark 101*b* into the path of the light beam issuing from the source 106. The signal from the device 113 is maintained at least until the receiver 107 transmits to the gate 108 a signal in response to detection of a mark 101*b*.

A signal is transmitted to the electromagnet 105 and to the lower input of the counter 112 as soon as a mark 101*b* reaches the light beam issuing from the source 106. As mentioned before, the signal from the AND-gate 108 can further serve to initiate the braking of motor 103A to thereby insure practically instantaneous stoppage of the web 101. The electromagnet 105 causes the knife 104 to sever the web 101 and the counter 112 is reset to zero. The motor 103A can be started again to move the next mark 101*b* into the range of the detector 106, 107. The signal at the output of the device 113 disappears not later than when the counter 112 again accumulates the selected number of pulses.

If a mark 101*b* is missing, the motor 103A continues to drive the roller 103 and the device 113 transmits a signal to the gate 108 but without any effect upon the electromagnet 105 because the gate 108 does not receive a signal from the receiver 107. The signal at the output of the device 113 disappears again after the elapse on an interval which has been selected for transmission of a signal to the lower input of the gate 108. The sum of pulses recorded by the counter 112 exceeds the number selected by the switch 116 whereby the second output of the counter 112 completes the circuit of the lamp 114 and opens the switch 115 to thereby arrest the motor 103A. The number of pulses which cause the counter 112 to complete the circuit of the signal lamp 114 preferably exceeds by at least one the number of pulses which are produced in response to lengthwise transport of the web 101 through a distance exceeding that between two successive marks 101*b*. The attendant notes that the lamp 114 is on and manually places the foremost unsevered frame line 101A into register with the knives 104, 104A prior to moving the knife 104 downwardly to separate the foremost print from the web 101.

It is clear that the web 101 can be (and normally is) provided with marks corresponding to the mark 1d of FIG. 1. Such additional marks can be applied to the web 101 in response to detection of successive splices which connect the ends of films in an elongated web of films and which are scanned at the copying station. The additional marks do not serve to initiate the movements of knife 104 but only to arrest the motor 103A upon completion of each customer order. This enables an attendant to remove all prints belonging to a customer from a receptacle which collects the prints downstream of the severing station. Proper monitoring of additional marks is of considerable importance in order to avoid a mixup of prints belonging to different customers and/or billing a customer for prints belonging to other customer(s).

Figure 5:
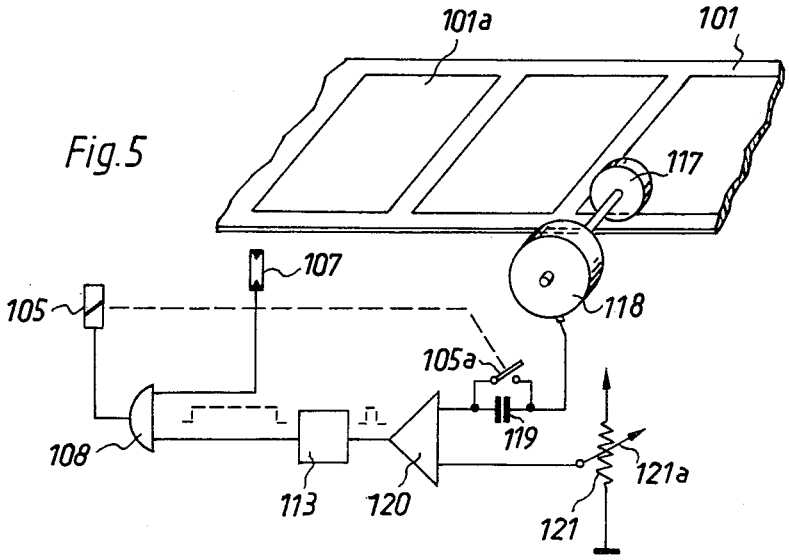
FIG. 5 is a similar view of still another apparatus.

FIG. 5 illustrates a portion of a further apparatus wherein a web 101, having images 101*a* of film frames, drives a roller 117 which in turn drives a tachometer generator 118. The output of the tachometer generator 118 transmits a signal to a capacitor 119 which constitutes an integrator. The capacitor 119 which constitutes an integrator. The capacitor 119 is connected in parallel with a normally open switch 105*a* which closes automatically in response to energization of the electromagnet 105. The capacitor 119 is connected to one input of an amplifier 120 the other input of which is connected to the sliding contact 121*a* of a potentiometer 121. The output of the amplifier 120 is connected to a signal holding device 113 which can transmit signals to one input of an AND-gate 108. The other input of the AND-gate 108 receives signals from the receiver 107 of the detector which monitors the web 101 for the presence of marks 101*b* (not shown in FIG. 5).

The operation is as follows:

At the start of transport of the web 101, the capacitor 119 discharges across the switch 105*a*. The tachometer generator 118 starts to generate a voltage signal whose intensity increases and which is stored by the capacitor 119. When the intensity of such signal matches the intensity of signal furnished by the potentiometer 121, the amplifier 120 transmits a signal to the holding circuit 113 which transmits a signal to the corresponding input of the AND-gate 108. This takes place shortly or immediately before a mark 101b (FIG. 4) reaches the receiver 107. The electromagnet 105 is energized to actuate the severing means for the web 101 when the gate 108 receives signals from the device 113 and receiver 107. At the same time, the electromagnet 105 closes the switch 105a to discharge the capacitor 119.

The tachometer generator 118 can be replaced with a voltage divider which is connected to a source of d-c current when the voltage applied to the capacitor 119 is proportional to the maximum speed of the web 101.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

We claim:

1. In an apparatus for treating a web which is provided with substantially uniformly spaced intentionally applied indicia, particularly for subdividing a web of photographic material into sections each of which carries the image of a film frame, a combination comprising advancing means operable to advance the web lengthwise along a predetermined path detector means adjacent to a portion of said path and arranged to scan the web for the presence of said indicia and to produce signals in response to detection of indicia; arresting means activatable to terminate the operation of said advancing means in response to said signals; means for deactivating said arresting means not later than on start of operation of said advancing means; means for activating said arresting means in response to transport of the web through a predetermined distance which is only slightly less than the distance between a pair of neighboring indicia on the web so that said arresting means can terminate the operation of said advancing means only after the web is transported through said predetermined distance to thus insure that said arresting means cannot be activated in response to signals produced by said detector means on detection of unintentionally applied indicia during transport of the web through said predetermined distance; and means for treating the web on stoppage of said advancing means.

2. A combination as defined in claim 1, wherein said treating means comprises means for severing the web in a second portion of said path, said means for activating comprising second detector means located downstream of said second portion of said path and arranged to produce signals for activation of said arresting means in response to detection of the leader of the web subsequent to severing of the web in said second portion of said path.

3. A combination as defined in claim 2, wherein at least one of said detector means comprises a photoelectric cell.

4. A combination as defined in claim 2, wherein the distance between said second detector means and said second portion of said path is slightly less than the distance between a pair of neighboring indicia.

5. A combination as defined in claim 1, further comprising time-delay means for delaying the transmission of signals from said detector means to said arresting means.

6. A combination as defined in claim 5, said treating means comprising means for severing the web in a second portion of said path and the distance between said portions of said path being different from the distance between two neighboring indicia on the web.

7. A combination as defined in claim 6, wherein said means for activating comprises second detector means located downstream of said second portion of said path and arranged to produce signals in response to detection of the leader of the web, the distance between said second detector means and said severing means being slightly less than the distance between two neighboring indicia of said web.

8. A combination as defined in claim 6, wherein said means for activating comprises second detector means located downstream of and separated from said first mentioned detector means by a distance slightly less than the distance between two neighboring indicia, said second detector means being arranged to supply to said time delay means signals in response to detection of said indicia.

9. A combination as defined in claim 6, wherein said means for deactivating comprises second detector means arranged to produce signals in response to detection of the leader of the web downstream of said severing means.

10. A combination as defined in claim 1, wherein said means for activating said arresting means comprises a time-delay device arranged to activate said arresting means for an interval whose deviation is proportional to maximum deviation of the distance between neighboring indicia from a preselected distance.

11. A combination as defined in claim 1, said treating means comprising means for severing the web in a second portion of said path and said means for severing being connected with said means for deactivating said arresting means.

12. A combination as defined in claim 1, wherein said means for activating comprises means for measuring the distance which the web covers after each start of said advancing means.

13. A combination as defined in claim 12, wherein said deactivating means is arranged to deactivate said arresting means in response to stoppage of said advancing means.

14. A combination as defined in claim 12, further comprising holding means for maintaining said arresting means in deactivated condition for a predetermined interval of time.

15. A combination as defined in claim 12, wherein said means for measuring comprises means for producing pulses in response to transport of the web by increments of unit length and said means for activating further comprises adjustable counter means connected with said means for measuring and arranged to activate said arresting means in response to reception of a preselected number of pulses.

16. A combination as defined in claim 12, wherein said means for measuring comprises means for producing signals whose intensity is proportional to the distance covered by said web, said means for activating further comprising an integrator connected with said means for producing signals and arranged to activate said arresting means in response to reception of signals of predetermined intensity.

17. A combination as defined in claim 16, wherein said means for producing signals comprises a tachometer generator.

18. A combination as defined in claim 16, wherein said means for producing signals comprises a voltage divider.

* * * * *